US008128389B2

(12) United States Patent
Nefedov et al.

(10) Patent No.: US 8,128,389 B2
(45) Date of Patent: Mar. 6, 2012

(54) POSITIVE-DISPLACEMENT MACHINE DESIGN (VARIANTS)

(75) Inventors: Sergei Ivanovich Nefedov, Moscow (RU); Aleksandr Ivanovich Zhirkin, Moscow (RU); Sergei Lvovich Solomonov, Moscow (RU); Yury Lazarevich Arzumanyan, Moscow (RU)

(73) Assignee: Sergei Ivanovich Nefedov, Moscow (RU)

( * ) Notice: Subject to any disclaimer, the term of this patent is extended or adjusted under 35 U.S.C. 154(b) by 470 days.

(21) Appl. No.: 12/448,561

(22) PCT Filed: Dec. 10, 2007

(86) PCT No.: PCT/RU2007/000696

§ 371 (c)(1),
(2), (4) Date: Jun. 25, 2009

(87) PCT Pub. No.: WO2008/079053

PCT Pub. Date: Jul. 3, 2008

(65) Prior Publication Data

US 2010/0054979 A1 Mar. 4, 2010

(30) Foreign Application Priority Data

Dec. 26, 2006 (RU) ..... 2006146230

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/150; 418/61.2; 418/61.3

(58) Field of Classification Search ..... 418/61.2, 418/61.3, 150

See application file for complete search history.

(56) References Cited

U.S. PATENT DOCUMENTS 3,199,496 A * 8/1965 Kell ..... 418/61.3

(Continued)

FOREIGN PATENT DOCUMENTS

JP 59087289 A * 5/1984

(Continued)

OTHER PUBLICATIONS

JP 05-202873A Leroy et al.—Positive Displacement Machine With Hypertrochoidal Geometry for Planetary Motion—Aug. 10, 1993.*

*Primary Examiner* — Theresa Trieu

(74) *Attorney, Agent, or Firm* — The Nath Law Group; Jerald L. Meyer; Derek Richmond

(57) ABSTRACT

In the first variant, the device comprises a stator and a rotor eccentrically mounted in the stator. A planetary train consists of large and small gear wheels. The large gear wheel is fixedly arranged on the outside of the small gear wheel and it is enabled to run around the small gear wheel of the planetary train. The stator is coupled with the large gear wheel and the rotor is coupled with the small gear wheel. In the second variant, the device comprises a stator and a rotor. The small gear wheel is fixedly arranged and the large gear wheel is enabled to run around the small gear wheel of the planetary train. The stator is coupled with the small gear wheel and the rotor is coupled with the large gear wheel. The equations describing the outlines of the stator and rotor are disclosed for the first and second variant.

2 Claims, 5 Drawing Sheets

U.S. PATENT DOCUMENTS

| | | | | | |
|---|---|---|---|---|---|
| 3,364,907 | A | * | 1/1968 | Jeanson | 418/61.3 |
| 3,771,501 | A | * | 11/1973 | DeDobo | 418/61.3 |
| 4,111,617 | A | | 9/1978 | Gale et al. | |
| 5,380,177 | A | | 1/1995 | Leroy et al. | |
| 5,439,357 | A | * | 8/1995 | Barthod et al. | 418/61.3 |

FOREIGN PATENT DOCUMENTS

| | | | | |
|---|---|---|---|---|
| JP | 05202873 | A | * | 8/1993 |
| RU | 2056712 | C1 | | 3/1996 |
| RU | 2199668 | C1 | | 2/2003 |
| RU | 2003 105201 | A | | 10/2004 |

* cited by examiner

POSITIVE-DISPLACEMENT MACHINE DESIGN (VARIANTS)

This is a National Phase Application filed under 35 U.S.C. 371 as a national stage of PCT/RU2007/000696, filed Dec. 10, 2007, an application claiming the benefit of Russian Patent Application No. 2006146230 filed Dec. 26, 2006, the entire content of each of which is hereby incorporated by reference in its entirety.

FIELD OF THE INVENTION

This invention relates to piston rotary machines of positive-displacement type and may be used in pumps, compressors, engines.

DESCRIPTION OF THE RELATED ART

A power unit is known, which includes: a shaft with an eccentric portion, a rotor-piston installed on the shaft eccentric portion and having the outer surface formed by the end surfaces and the convex side surface, a stator with an inner space for arranging the rotor-piston, the said space being formed by two plane parallel end walls and the closed side wall with three working sections permanently contacting the rotor-piston, segments arranged on the working sections of the stator side wall, a mesh engagement in the form of a gear connected to the rotor-piston, and a wheel with inner teeth, the said wheel being fixedly connected to the stator, where each cross-section of the rotor-piston side surface being a convex closed line having two points most distant from the eccentric portion shaft axis and located symmetrically relative to the axis, and each cross-section of the stator side wall, which is orthogonal to the shaft axis, having the form of regular triangle with rounded corners and straight or smooth convex side lines, and the stator inner volume is subdivided into three working chambers of variable volume by the rotor-piston convex side surface tangent lines to the three working portions of the stator. This power unit has a sleeve with the outer diameter d, which is fixedly connected to the rotor-piston, a round opening is provided in the stator end wall, which is coaxial to the shaft and which diameter is greater than E+0.5d, where E is the distance between the said shaft axis and the said eccentric portion axis; a rotatable disc is arranged in the said opening and coaxially to the shaft; the sleeve goes beyond the stator inner volume and passes through an opening in the rotatable disc; the gear of the gear meshing is fixedly connected and coaxial to the sleeve; the said gear meshing is arranged in the stator beyond its inner volume; and a ring seal is installed between the stator and the rotatable disc (RU, 2056712).

A positive-displacement machine is also known, which includes: a hollow stator with the inner cylindrical surface which guide has the form of a line delimiting a regular M-gon; a rotor arranged in the stator cavity eccentrically and with the possibility of planetary movement relative to the cavity axis, and forming, while moving, M working chambers of variable volume, each being isolated from another, due to contacts between its side surface and sections of the stator inner cylindrical surface in the section of its M-angles; a front end cover on which a movable shaft is installed coaxially to the stator cavity axis; a rear end cover rigidly and hermetically connected to the stator; and a valve distributing mechanism; wherein the rotor cross-section is a plane figure with M−1 similar convex sides smoothly conjugated between them and has a symmetry axis of M−1 order, which coincides with the rotor rotation axis. The front cover of the positive-displacement machine is fixedly and hermetically connected to the stator which is made integral, the stator being connected to the front and the rear end covers, forming the first and the second circular cavities coaxial to the shaft and communicating to the stator cavity along their inner perimeter, the valve distributing mechanism includes an inlet and an outlet disc valves coaxial to the rotor, the disc valves are made, respectively, as the first and the second end flanges of the rotor and arranged, respectively, in the first and the second circular cavities with the possibility of ensuring free movement of the rotor, contactless sealing the variable-volume working chambers at their ends due to a minimum guaranteed gap between them and the side walls of the respective circular cavities, and ensuring, while moving, regular covering of M-inlet channels made in the rear end cover and regular connecting M-outlet channels made in the stator in the section of each angle of the stator cylindrical surface to the collecting outlet cavity, where M is an integer equal or greater than 3 (RU, 2199668).

Furthermore, the shaft of this positive-displacement machine is made with an eccentric section located in the stator cavity and being the rotor axis, which is provided with an planetary drive inner wheel having an outer ring gear engaging the inner ring gear of the stationary outer wheel provided on the rear end cover.

However, the above technical solutions do not solve the task of optimizing the profile of the rotor external surface and the stator inner surface for the purpose of constructing positive-displacement machines having high performance and efficiency.

An attempt to define mathematical equations for forms of the rotor external surface and the stator inner surface was made in the application for an invention No. RU 2003105201 published on 25 Feb. 2003) for a power unit similar to those described in the two above-described technical solutions. This power unit comprises a shaft with an eccentric portion, a rotor-piston with a side surface and flat end walls, a drive mechanism for the rotor-piston, a distributing device for the working body, a working cylinder having an inner side surface, end walls and an inner volume, the rotor-piston being installed on the shaft eccentric portion and arranged in the inner volume of the working cylinder; each cross-section profile of the inner side surface of the working cylinder, which is orthogonal to the shaft axis, has the form of N-gon, where N is equal or greater than 3, each cross-section profile of the rotor-piston side surface, which is orthogonal to the shaft axis, has, when N=3, an oyster form, and, when N is greater than 3, has the form of a regular curvilinear (M−1)-gon; the working cylinder has N working sections on its inner side surface, which sections are in contact with the rotor-piston side surface; the working cylinder inner volume is subdivided into N working chambers of variable volume by contact lines between the rotor-piston side surface and the working sections of the working cylinder side surface; an inlet-outlet opening is provided in each of N angular portions of the working cylinder; the working body distributing device comprises a rotatable valve device, a drive mechanism for the rotatable valve device and N main lines for the working body, the N main lines for the working body being connected to the respective N inlet-outlet openings; the valve device rotation axis coincides with the power unit shaft axis; the drive mechanism for the rotatable valve device is connected to the shaft. The rotatable valve device is made in the form of one plane distributing disc comprising (N−1) through inlet openings and (N−1) through outlet openings for simultaneous distribution of the working body in all the N working chambers of the working cylinder through the N main lines for the working body and the N inlet-outlet openings.

The principal identifying feature of the rotor-stator configurations of the above analogous solutions is the availability of flat rectangular facets included into the side surface of the stator working cavity, in totality comprising multiple radial contact points. Out of the other external features the following may be mentioned: profile curves, both of the rotor and the working cavity, are enveloping, i.e., relating to the class of discriminants, due to which these piston rotary machines may be called discriminant.

For such machines the said cross-section profile of the rotor-piston side surface in the conventional technical solution can be described in the x and y rectangular coordinate system by the following equations:

$$x=(z-1)\cdot e\cdot(\cos\alpha)/2-(z+1)\cdot e\cdot(\cos\beta)/2+a\cdot\cos[\pi/(z+1)]\cdot\cos\gamma;$$

$$y=(z-1)\cdot e\cdot(\sin\alpha)/2+(z+1)\cdot e\cdot(\sin\beta)/2+a\cdot\cos[\pi/(z+1)]\cdot\sin\gamma;$$

where: e is eccentricity (distance between the axes of the main shaft portion and the eccentric shaft portion);

z=N−1, where N is number of angles in a regular N-gon with curvilinear angular sections, which is formed in the working cylinder cross section, N>3;

a is radius of circle circumscribed around a regular N-gon;

$$\alpha=(z+1)\cdot\Phi;$$

$$\beta=(z-1)\cdot\Phi-2\pi/(z+1);$$

$$\gamma=\Phi+\pi/(z+1);$$

$\Phi$—angular parameter;

$$0\leqq\Phi\leqq2\pi,$$

and the said cross-section profile of the working cylinder inner side surface is a regular N-gon and has curvilinear angular sections in the angles of this regular N-gon, where the form of a profile of the working cylinder cross section for curvilinear angular sections can be described in the x and y rectangular coordinate system by the following equations:

$$x=(z+3)\cdot e\cdot[\cos(z\chi)]/2-(z-1)\cdot e\cdot\cos[z(z+3)\chi/(z-1)]/2++a\cdot\cos[\pi/(z+1)]\cdot\cos[2z\chi/(z-1)];$$

$$y=-(z+3)\cdot e\cdot[\sin(z\chi)]/2-(z-1)\cdot e\cdot\sin[z(z+3)\chi/(z-1)]/2++a\cdot\cos[\pi/(z+1)]\cdot\sin[2z\chi/(z-1)];$$

and the profile of the rectilinear sections in the cross-section of the working cylinder inner side surface can be described by the following equations:

$$x=(z+1)\cdot e\cdot\sin[z\chi+(2k+1)\pi/(z+1)]\cdot\sin[(2k+1)\pi/(z+1)]++a\cdot\cos[\pi/(z+1)]\cdot\cos[(2k+1)\pi/(z+1)];$$

$$y=(z+1)\cdot e\cdot\sin[z\chi+(2k+1)\pi/(z+1)]\cdot\cos[(2k+1)\pi/(z+1)]++a\cdot\cos[\pi/(z+1)]\cdot\sin[(2k+1)\pi/(z+1)];$$

where: e is eccentricity (distance between the axes of the main shaft portion and the eccentric shaft portion);

z=N−1, where N is number of angles in a regular N-gon which is formed in the cross section of the working cylinder, N>3;

x is an angle of rotor-piston rotation around the axis of the eccentric shaft portion, $0\leqq\chi\leqq2\pi$;

a is radius of circle circumscribed around the regular N-gon;

k is the number of a working section on the working cylinder inner surface.

(See, Application for an invention No. RU 2003105201, published on 25 Feb. 2003).

The "rotor-stator" configuration for piston rotary machines of discriminant type, as described above and expressed in the above equations, is characterized by a number of specific features that drastically reduce its practical significance level.

Only one variant of mutual orientation of a rotor and a stator during their mounting is fixed in this configuration. That is, a position of a rotor relative to the axis going through its geometric center and the initial point of contact between the small and the large gears of the planetary train (these gears are the main structural elements of a mechanism used for synchronizing movements of the driving shaft and the rotor) may be determined in a single way; a position of the stator working cavity profile relative to the said axis can also be determined in a just one way—it formally means that the rotor-stator configuration in the conventional technical solution is determined by only three values, namely: number of rotor vertexes (z), eccentricity (e) and form parameter (a*=a/e). This fact introduces serious problems into technological processes of making and assembling a rotor-stator pair.

Another conventional solution realizes the case where a small gear is connected to the rotor and the large gear is connected to the stator, without realizing the reverse variant where the small gear is connected to the stator and the large gear is connected to the rotor. So, a rotor-stator configuration cannot be determined for the reverse case under the conventional equations, which significantly delimits the applications of rotary machines.

The conventional equations do not set the lower limits for values of the non-dimensional parameter=a/e, incompliance with which results in that "loops" appear in the rotor profile vertexes and, as a consequence, in that the possibility of realizing this analogous solution in practice is lost.

There is no identification of conjugation points between curvilinear and rectilinear sections of the stator working cavity profile in the conventional equations, which does not enable to accurately realize forms of the rotor and the stator.

Only one conjugation curve is used for conjugating the stator profile rectilinear and curvilinear sections in the analogous solution, but an equation analysis conducted for the proposed technical solution shows that two curves are necessary for accurate conjugation at odd values of z-parameter for the first embodiment or at even values of z-parameter for the second embodiment. Thus, the closest analogous solution does not work at the stated values of the engagement parameter z.

Finally, the closest analogous solution does not work for a significant number of its applications, and in particular realization cases, e.g., in engines, compressors or pumps, if they are made with low accuracy, they will have lower specific capacity, power, efficiency and reduced service life.

SUMMARY OF THE INVENTION

The objective of this invention is to create variants of a positive-displacement machine, which enable raising efficiency, specific capacity and power by optimizing rotor-stator working surface configuration and accuracy of their making, and, thus, to raise performance of discriminant piston rotary machines and expand their fields of application.

In order to achieve this objective, two embodiments of the invention are proposed.

Under the first embodiment, in a conventional arrangement of a positive-displacement machine, which comprises a stator, a rotor installed eccentrically in the stator, a planetary train composed of a large gear and a small gear, where the large gear being fixedly installed in engagement on the outside of the small gear, the small gear being made with the possibility of running around the large gear of the planetary train, the stator is connected to the large gear, and the rotor is connected to the small gear of the planetary train, according to the invention the external surface profile of the rotor in its cross section is an envelope of a family of straight lines, and the line $y_z$, which generates this family, is fixedly connected to the large gear and is set by the following equation in the $O_1X_1Y_1$ coordinate system the beginning of which is at the center of the large gear:

$$y_z = tgA \cdot x_1 + \frac{\sin(B-A)}{\cos A} \cdot a,$$

where: A is the inclination angle of the straight line $y_z$ to the axis $O_1X_1$, ($0 \leqq A \leqq \pi$);

$x_1$ is the coordinate of the current point of the straight line $y_z$ along $O_1X_1$;

B is the inclination angle of a section connecting the beginning $O_1$ of the $O_1X_1Y_1$ coordinate system to the straight line $y_z$ and calculated from the axis $O_1X_1$ ($0 \leqq B \leqq \pi$ and $B \neq A$);

a is length of the section connecting the beginning $O_1$ of the $O_1X_1Y_1$ coordinate system to the straight line $y_z$;

and the rotor profile is made in accordance with the following parametric equation:

$$x = e\left[\frac{z-1}{2}\cos\alpha + \frac{z+1}{2}\cos\beta - a^*\sin(B-A)\sin\gamma)\right],$$

$$y = e\left[\frac{z-1}{2}\sin\alpha - \frac{z+1}{2}\sin\beta + a^*\sin(B-A)\cos\gamma\right],$$

where: x, y are current coordinates of the profile points along the axes X, Y of the OXY Cartesian coordinate system the beginning of which is at the center of the small gear;

e is an eccentricity value;

z is an engagement parameter, z=2, 3 . . . ;

$\alpha=(z+1)\Psi$, $\Psi$ is a rotation angle of the large gear relative to the small gear, which is counted from the X axis in the OXY coordinate system the beginning of which is at the center of the small gear, serving as a parameter, $0 \leqq \Psi \leqq 2\pi$, $$\beta=(z-1)\psi-2A,$$

$$\gamma=\psi+A,$$

a* is a form parameter defined as a*=a/e and satisfying the following condition:

$$a^* \geq \frac{z^2-1}{|\sin(B-A)|},$$

and the inner surface profile of the stator in its cross section is made of z+1 rectilinear sections, each of them made corresponding to the following parametric equation:

$$x_k=e[(z+1)\cos\delta\cos\eta-a^*\sin(B-A)\sin\xi],$$

$$y_k=e[(z+1)\sin\delta\cos\eta+a^*\sin(B-A)\cos\xi],$$

where: $x_k$, $y_k$ are current coordinates of the stator profile points along the axes $X_1$, $Y_1$ of the $O_1X_1Y_1$ Cartesian coordinate system, the beginning of which is at the center of the large gear;

k=0, 1, . . . z is the number of a rectilinear section, $$\delta = A + 2k\frac{\pi}{z+1},$$

$$\pi = 3{,}14,$$

$$\eta = z\chi + A + 2k\frac{\pi}{z+1},$$

$\chi$ is a rotation angle of the small gear relative to the large gear, which is counted from the axis $X_1$ in the $O_1X_1Y_1$ coordinate system the beginning of which is at the center of the large gear, serving as a parameter, for which:

$$\pi - \left(A + \frac{2k\pi}{z+1}\right) \leq z\chi \leq 2\pi - \left(A + \frac{2k\pi}{z+1}\right), \text{ if } 0 \leq A + \frac{2k\pi}{z+1} \leq \pi,$$

$$2\pi - \left(A + \frac{2k\pi}{z+1}\right) \leq z\chi \leq 3\pi - \left(A + \frac{2k\pi}{z+1}\right), \text{ if } B - A < 0$$

and $$\pi \leq A + \frac{2k\pi}{z+1} \leq 2\pi, \text{ or if } B - A > 0 \text{ and } A + \frac{2k\pi}{z+1} \geq \pi,$$

$$3\pi - \left(A + \frac{2k\pi}{z+1}\right) \leq z\chi \leq 4\pi - \left(A + \frac{2k\pi}{z+1}\right), \text{ if } B - A < 0$$

and $$A + \frac{2k\pi}{z+1} \geq 2\pi,$$

$$\xi = A + 2k\frac{\pi}{z+1},$$

where adjacent rectilinear sections of the stator profile are conjugated between them by z+1 curvilinear sections, each of the latter being made as an arch corresponding either to the following parametric equation:

$$x' = e\left[\frac{z+3}{2}\cos\vartheta + \frac{z-1}{2}\cos\tau - a^*\sin(B-A)\sin\mu\right],$$

$$y' = e\left[-\frac{z+3}{2}\sin\vartheta + \frac{z-1}{2}\sin\tau + a^*\sin(B-A)\cos\mu\right],$$

where x', y' are current coordinates of the conjugating arches along the axes $O_1X_1$, $O_1Y_1$;

$\theta$ is parameter defined on the section $$\frac{z-1}{z+1}k\pi - A \leq \vartheta \leq \frac{z-1}{z+1}(k+1)\pi - A,$$

if k is an even number and B−A<0, or if k is an odd number and B−A>0.

or $\theta$ is parameter defined on the section $$\frac{z-1}{z+1}(k+z+1)\pi - A \leq \vartheta \leq \frac{z-1}{z+1}(k+z+2)\pi - A,$$

if z is an even number, k is an odd number and B−A<0, or if z is an even number, k if an odd number and B−A>0, $$\tau = \frac{(z+3)}{z-1}\vartheta + 2\frac{z+1}{z-1}A,$$

$$\mu = \frac{2}{z-1}\vartheta + \frac{z+1}{z-1}A,$$

or to the following parametric equation:

$$x' = e\begin{bmatrix} \frac{z+3}{2}\cos\left(\vartheta - \frac{2\pi}{z+1}\right) + \\ \frac{z-1}{2}\cos\left(\tau + \frac{2\pi}{z+1}\right) - \\ a^*\sin(B-A)\sin\left(\mu + \frac{2\pi}{z+1}\right) \end{bmatrix},$$

$$y' = e\begin{bmatrix} -\frac{z+3}{2}\sin\left(\vartheta - \frac{2\pi}{z+1}\right) + \\ \frac{z-1}{2}\sin\left(\tau + \frac{2\pi}{z+1}\right) + \\ a^*\sin(B-A)\cos\left(\mu + \frac{2\pi}{z+1}\right) \end{bmatrix},$$

where: θ is parameter defined on the section $$\frac{z-1}{z+1}(k+1)\pi - A \le \vartheta \le \frac{z-1}{z+1}k\pi - A,$$

if z is an odd number, k is an odd number and B−A<0 or θ is parameter defined on the section $$\frac{z-1}{z+1}(k-1)\pi - A \le \vartheta \le \frac{z-1}{z+1}k\pi - A,$$

if z is an odd number, k if an even number and B−A>0.

Under the second embodiment, in a conventional arrangement of a positive-displacement machine, which comprises a stator, a rotor installed eccentrically in the stator, a planetary train composed of a large gear and a small gear, where the small gear being installed in engagement on the inside of the large gear, according to the invention the small gear is fixedly installed, and the large gear is made with the possibility of running around the small gear of the planetary train, the stator is connected to the small gear, and the rotor is connected to the large gear of the planetary train, the external surface profile of the rotor in its cross section is an envelope of a family of straight lines, and the line $y_z$, which generates this family, is fixedly connected to the small gear and is set by the following equation in the $O_1X_1Y_1$ coordinate system the beginning of which is at the center of the small gear:

$$y_z = tgA \cdot x_1 + \frac{\sin(B-A)}{\cos A} \cdot a,$$

where: A is the inclination angle of the straight line $y_z$ to the axis $O_1X_1$, (0≦A≦π);

$x_1$ is the coordinate of the current point of the straight line $y_z$ along $O_1X_1$;

B is the inclination angle of a section connecting the beginning $O_1$ of the $O_1X_1Y_1$ coordinate system to the straight line $y_z$ and calculated from the axis $O_1X_1$ (0≦B≦π and B≠A);

a is length of the section connecting the beginning $O_1$ of the $O_1X_1Y_1$ coordinate system to the straight line $y_z$;

and the rotor external surface profile is made in accordance with the following parametric equation:

$$x = e\left[\frac{z+2}{2}\cos\alpha_1 + \frac{z}{2}\cos\beta_1 - a^*\sin(B-A)\sin\gamma_1\right],$$

$$y = e\left[-\frac{z+2}{2}\sin\alpha_1 - \frac{z}{2}\sin\beta_1 + a^*\sin(B-A)\cos\gamma_1\right],$$

where: x, y are current coordinates of the profile points along the axes X, Y of the OXY Cartesian coordinate system the beginning of which is at the center of the large gear;

e is an eccentricity value;

z is an engagement parameter, z=2, 3 . . . ;

a* is a form parameter defined as a*=a/e and satisfying the following condition:

$$a^* \ge \frac{z(z+2)}{|\sin(B-A)|},$$

$$\alpha_1 = zt$$

t is a rotation angle of the small gear relative to the large gear, which is counted from the axis X in the OXY coordinate system the beginning of which is at the center of the large gear, serving as a parameter, for which 0≦t≦2π;

$$\beta_1 = (z+2)t + 2A,$$

$$\gamma_1 = t + A,$$

and the inner surface profile of the stator in its cross section is made of z rectilinear sections, each of them made corresponding to the following parametric equation:

$$x_n = e[z\cos\delta_1\cos\eta_1 - a^*\sin(B-A)\sin\xi_1],$$

$$y_n = e[z\sin\delta_1\cos\eta_1 + a^*\sin(B-A)\cos\xi_1],$$

where $x_n$, $y_n$ are current coordinates of the stator profile points along the axes $X_1$, $Y_1$ of the $O_1X_1Y_1$ Cartesian coordinate system the beginning of which is at the center of the small gear;

n=0, 1, . . . (z−1) is the number of a rectilinear section, $$\delta_1 = A + 2n\frac{\pi}{z},$$

$$\pi = 3{,}14,$$

$$\eta_1 = (z+1)\rho - \left(A + 2n\frac{\pi}{z}\right),$$

ρ is a rotation angle of the large gear relative to the small gear, which is counted from the axis $X_1$ in the $O_1X_1Y_1$ coordinate system the beginning of which is at the center of the small gear, serving as a parameter, for which:

$$A + \frac{2n\pi}{z} \le (z+1)\rho \le \pi + \left(A + \frac{2n\pi}{z}\right), \quad \text{if } 0 \le A + \frac{2n\pi}{z} \le \pi,$$

$$A + \frac{2n\pi}{z} - \pi \le (z+1)\rho \le A + \frac{2n\pi}{z}, \quad \text{if } B - A < 0 \text{ and}$$

-continued $$\pi \le A + \frac{2n\pi}{z} \le 2\pi, \quad \text{or if } B - A > 0 \text{ and } A + \frac{2n\pi}{z} \ge \pi,$$

$$A + \frac{2n\pi}{z} - 2\pi \le (z+1)\rho \le A + \frac{2n\pi}{z} - \pi, \quad \text{if } B - A < 0 \text{ and}$$

$$A + \frac{2n\pi}{z} \ge 2\pi,$$

$$\xi_1 = A + 2n\frac{\pi}{z},$$

where adjacent rectilinear sections of the stator profile are conjugated between them by z curvilinear sections, each of the latter being made as an arch corresponding either to the following parametric equation:

$$x' = e\left[\frac{z-2}{2}\cos\vartheta + \frac{z+2}{2}\cos\tau_1 - a^*\sin(B-A)\sin\mu_1\right],$$

$$y' = e\left[\frac{z-2}{2}\sin\vartheta - \frac{z+2}{2}\sin\tau_1 + a^*\sin(B-A)\cos\mu_1\right],$$

where x', y' are current coordinates of the conjugating arches along the axes $O_1X_1$, $O_1Y_1$;

θ is parameter defined on the section $$\frac{z+2}{z}k\pi + A \le \vartheta \le \frac{z+2}{z}(k+1)\pi + A,$$

if k is an even number and B−A<0, or if k is an odd number and B−A>0, or θ is parameter defined on the section $$\frac{z+2}{z}(k+z)\pi + A \le \vartheta \le \frac{z+2}{z}(k+z+1)\pi + A,$$

if z is an odd number, k is an odd number and B−A<0, or if z is an odd number, k is an even number and B−A>0

$$\tau_1 = \frac{z-2}{z+2}\vartheta - \frac{2z}{z+2}A,$$

$$\mu_1 = \frac{2}{z+2}\vartheta + \frac{z}{z+2}A,$$

or to the following parametric equation:

$$x' = e\begin{bmatrix} \frac{z-2}{2}\cos\left(\vartheta + \frac{2\pi}{z}\right) + \\ \frac{z+2}{2}\cos\left(\tau_1 - \frac{2\pi}{z}\right) - \\ a^*\sin(B-A)\sin\left(\mu_1 + \frac{2\pi}{z}\right) \end{bmatrix},$$

$$y' = e\begin{bmatrix} \frac{z-2}{2}\sin\left(\vartheta + \frac{2\pi}{z}\right) - \\ \frac{z+2}{2}\sin\left(\tau_1' - \frac{2\pi}{z}\right) + \\ a^*\sin(B-A)\cos\left(\mu_1 + \frac{2\pi}{z}\right) \end{bmatrix},$$

where θ is parameter defined on the section $$\frac{z+2}{z}(k-1)\pi + A \le \vartheta \le \frac{z+2}{z}k\pi + A,$$

if z is an even number, k is an odd number and B−A<0, or if z is an even number, k is an even number and B−A>0.

For the first and the second embodiments of this invention θ is the parameter representing a rotation angle of the driving shaft connected, in the first case, to the small gear, or, in the second case, to the large gear.

The mentioned advantages as well as specific features of this invention will be further explained on its possible embodiments with reference to the appended drawings.

DESCRIPTION OF THE PREFERRED EMBODIMENTS

Figure 1:
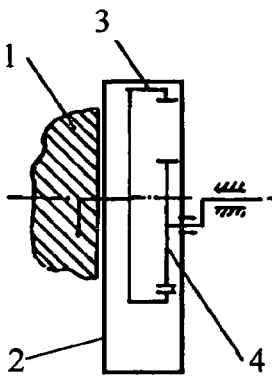
FIG. 1 shows a kinematic diagram of the first embodiment of the positive displacement machine, where the small gear is connected to the rotor, and the large gear is connected to the stator.
Figure 2:
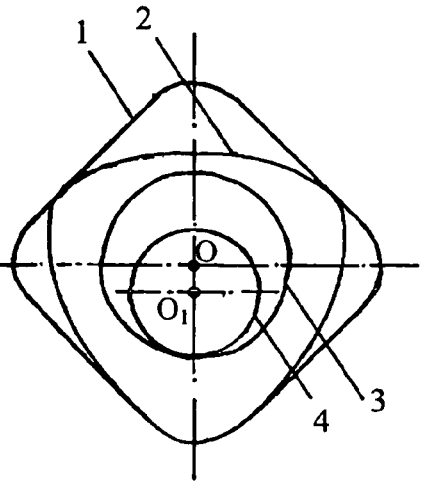
FIG. 2—same as FIG. 1, an illustrative assembling diagram.
Figure 3:
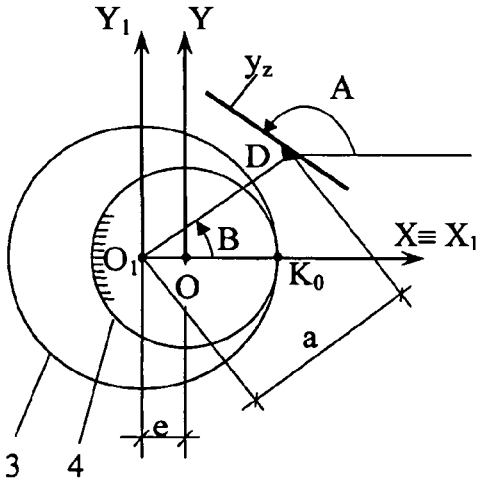
FIG. 3 shows the initial position of the planetary train large and small gears for the first embodiment of the invention when constructing the rotor external surface profile.

According to the first embodiment (FIGS. 1, 2), the positive-displacement machine comprises the stator 1 and the rotor 2 arranged eccentrically in the stator 1. The planetary train consists of a large gear 3 and a small gear 4. The large gear 3 is fixedly installed in engagement outside the small gear 4 made with the possibility of running around the large gear 3 of the planetary train. The stator 1 is connected to the large gear 3, and the rotor is connected to the small gear 4 of the planetary train. The external surface profile of the rotor 2 in its cross section is an envelope of a family of straight lines, and the straight line $y_z$ generating this family is fixedly connected to the large gear 3 and in the $O_1X_1Y_1$ coordinate system (FIG. 3-5) the beginning of which is at the center of the large gear 3. Eccentricity e is the distance between the centers of the stator 1 and the rotor 2, which corresponds to the distance between the centers of the large gear 3 and the small gear 4 (FIG. 3).

According to the second embodiment (FIGS. 10, 11), the positive-displacement machine comprises the stator 1 and the rotor 2 arranged eccentrically in the stator 1. The planetary train consists of the large gear 3 and the small gear 4. The small gear 4 is installed in engagement inside the large gear 3. The small gear is installed fixedly, and the large gear 3 is made with the possibility of running around the small gear 4 of the planetary train. The stator 1 is connected to the small gear 4, and the rotor is connected to the large gear 3 of the planetary train.

Figure 10:
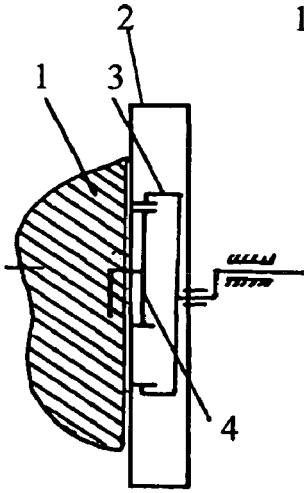
FIG. 10 shows a kinematic diagram of the embodiment of the positive-displacement machine, where the small gear is connected to the stator, and the large gear is connected to the rotor.
Figure 11:
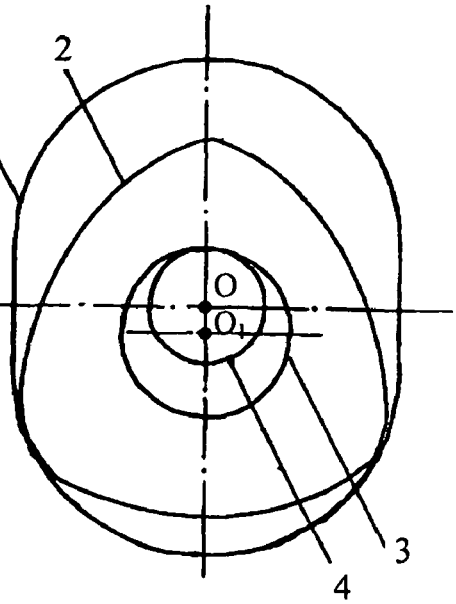
FIG. 11—same as FIG. 10, an illustrative assembling diagram.
Figure 12:
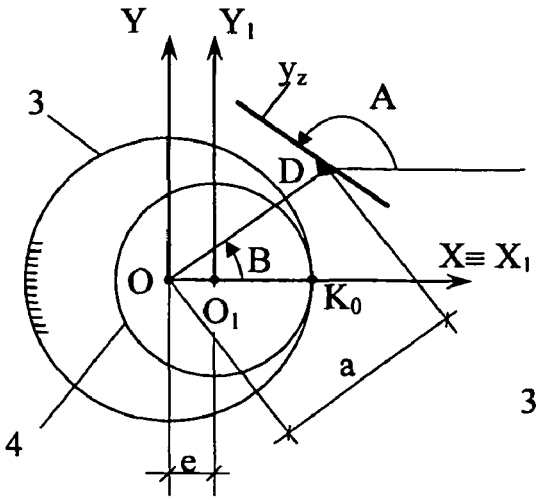
FIG. 12 shows the initial positions of the planetary train large and small gears for the second embodiment of the invention when constructing the rotor external surface profile.

The profile of the rotor 2 is an envelope of an Lz family of straight lines, and the straight line $y_z$, which generates them, is connected either to the large gear 3 (for the first embodiment, FIG. 3) or to the small gear 4 (for the second embodiment, FIG. 12), and is set by the following equation:

$$y_z = tgAx + \frac{\sin(B-A)}{\cos A}a, \tag{1}$$

where: A is an angle which initially determines the orientation of the straight line $y_z$ relative to the fixed axis X (it goes through the contact point $K_0$ in its initial position and through the center of the small gear 4 O for the first embodiment (FIGS. 2, 3) or through the center of the large gear 3 O for the second embodiment (FIGS. 10, 11);

B is an angle which determines the orientation of the section $O_1D$ fixing the connection of the straight line with the large gear 3 for the first embodiment (FIG. 2) or with the small gear 4 for the second embodiment (FIG. 10).

Formation of the profile of the stator 1 is related to finding an envelope, but in this case that of the Kz family of curved lines, where each of them is a profile curve of the rotor 1.

The radius R of the large gear 3 and the radius r of the small gear 4 are coupled by the following relation:

$$\frac{r}{R} = \frac{z}{z+1}, \tag{2}$$

where: z is the engagement parameter having even-number values starting from 2 for both embodiments of the invention.

Construction of the profile of the rotor 2 (FIGS. 3, 4) for the first embodiment is connected with determining an envelope for a Lz family of straight lines $y_z$.

Figure 4:
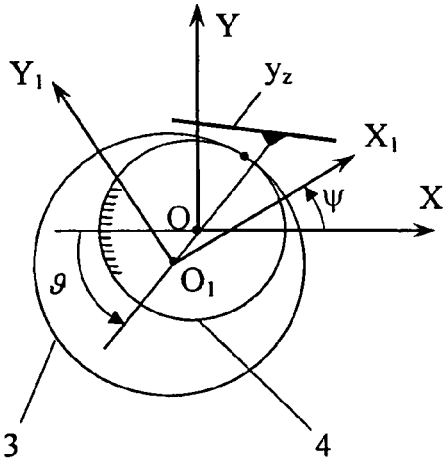
FIG. 4—same as FIG. 3, for intermediate positions of the large and the small gears.
Figure 5:
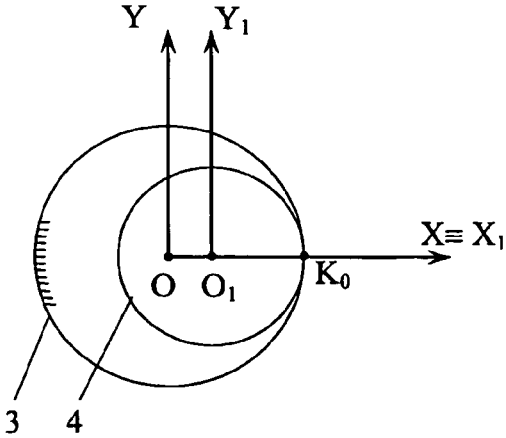
FIG. 5—shows the initial position of the planetary train large and small gears for the first embodiment of the invention when constructing the stator inner surface profile.

A Lz family of straight lines at a fixed z is formed in the process of running around the small gear 4 with external engagement by the large gear 3 with inner engagement. During this, the respective rotation angle θ of the section $OO_1$ (its length is equal to the eccentricity value e) and the rotation angle Ψ of the large gear 3 correspond to each moment of time (FIG. 4). During running around, the straight line $y_z$ does not change its position in the $OX_1Y_1$ coordinate system, which is movable and linked with the large gear, but its position in the OXY coordinate system, which is fixed and linked with the small gear 3 is continuously changed.

The parametric equation for an envelope of the Lz family, or, what is the same, of the profile of the rotor 2 in the OXY coordinate system, has, as described above, the following form:

$$x = e\left[\frac{z-1}{2}\cos\alpha + \frac{z+1}{2}\cos\beta - a^*\sin(B-A)\sin\gamma)\right], \tag{3}$$

$$y = e\left[\frac{z-1}{2}\sin\alpha - \frac{z+1}{2}\sin\beta + a^*\sin(B-A)\cos\gamma\right],$$

where: x, y are current coordinates of the profile points along the X, Y axes of the OXY Cartesian coordinate system the beginning of which is at the center of the small gear;

e is an eccentricity value;

z is an engagement parameter, z=2, 3 . . . ;

$\alpha=(z+1)\Psi$;

Ψ is a rotation angle of the large gear relative to the small gear, which is counted from the X axis in the OXY coordinate system the beginning of which is at the center of the small gear, serving as a parameter, $0 \leqq \Psi \leqq 2\pi$, $$\beta=(z-1)\psi-2A,$$

$$\gamma=\psi+A,$$

a* is the form parameter defined as a*=a/e and satisfying the following condition:

$$a^* \geq \frac{z^2-1}{|\sin(B-A)|},$$

Figure 7:
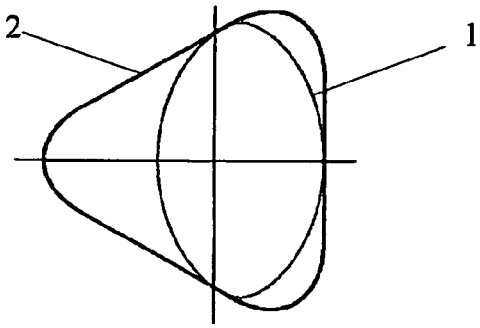
FIG. 7—an exemplary rotor-stator configuration according to the first embodiment for z=2.
Figure 8:
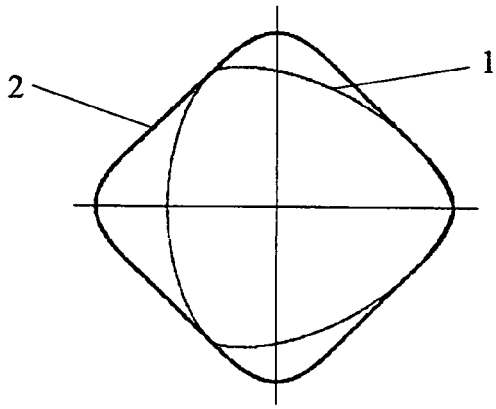
FIG. 8—same as FIG. 7, for z=3.
Figure 9:
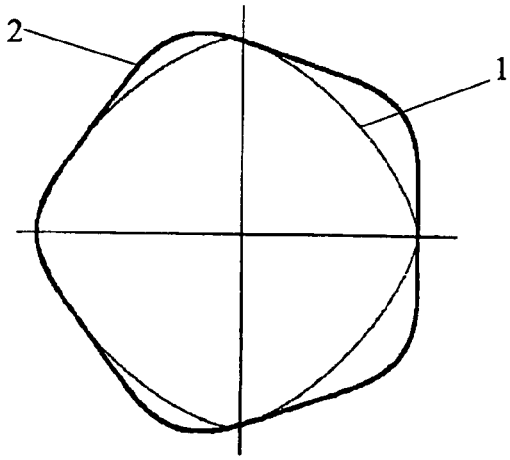
FIG. 9—same as FIG. 7, for z=4.

The rotor profile, as described by this equation, has z similar branches and z vertexes ($z \geqq 2$) (FIG. 7-9).

Figure 6:
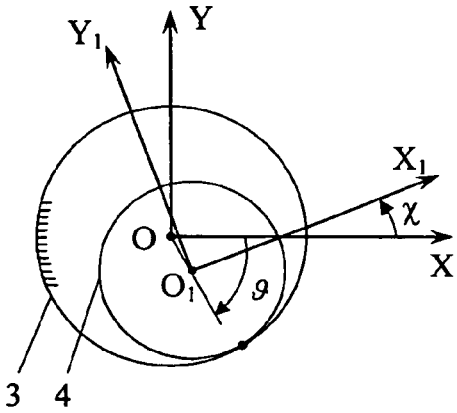
FIG. 6—same as FIG. 5, for intermediate positions of the large and the small gears.

Profile construction for the stator 1 (FIGS. 5, 6) in the first embodiment of the invention is also connected with determining an envelope, but now for a Kz family of curved lines formed during running around the large gear 3 by the small gear 4 (FIGS. 5, 6), and more correctly during running around the rotor 2 connected to the large gear, where a definite position of its profile curve corresponds to each rotation angle. A totality of such curves will form a Kz family of curved lines. At this point the indexation of the coordinate systems is changed: now the $O_1X_1Y_1$ movable system relates to the small gear 4, and the OXY fixed system relates to the large gear. And the beginnings of these systems are located at the respective centers of the small gear 4 and the large gear 3.

The profile of the stator 1, i.e., the envelope of the Kz family of curved lines, consists of z+1 rectilinear sections, and the parametric equation for each of them has the following form:

$$x_k=e[(z+1)\cos\delta\cos\eta-a^*\sin(B-A)\sin\xi],$$

$$y_k=e[(z+1)\sin\delta\cos\eta+a^*\sin(B-A)\cos\xi], \tag{4}$$

where $x_k$, $y_k$ are current coordinates of the stator profile points along the $X_1$, $Y_1$ axes of the $O_1X_1Y_1$ Cartesian coordinate system the beginning of which is at the center of the large gear;

k=0, 1, . . . z is the number of a rectilinear section;

$$\delta = A + 2k\frac{\pi}{z+1},$$

$$\pi = 3{,}14,$$

$$\eta = z\chi + A + 2k\frac{\pi}{z+1},$$

$\chi$ is a rotation angle of the small gear relative to the large gear, which is counted from the $X_1$ axis in the $O_1X_1Y_1$ coordinate system the beginning of which is at the center of the large gear, serving as a parameter, for which $$\pi - \left(A + \frac{2k\pi}{z+1}\right) \le z\chi \le 2\pi - \left(A + \frac{2k\pi}{z+1}\right),$$

$$\text{if } 0 \le A + \frac{2k\pi}{z+1} \le \pi,$$

$$2\pi - \left(A + \frac{2k\pi}{z+1}\right) \le z\chi \le 3\pi - \left(A + \frac{2k\pi}{z+1}\right),$$

$$\text{if } B - A < 0 \text{ and } \pi \le A + \frac{2k\pi}{z+1} \le 2\pi,$$

$$\text{or if } B - A > 0 \text{ and } A + \frac{2k\pi}{z+1} \ge \pi,$$

$$3\pi - \left(A + \frac{2k\pi}{z+1}\right) \le z\chi \le 4\pi - \left(A + \frac{2k\pi}{z+1}\right),$$

$$\text{if } B - A < 0 \text{ and } A + \frac{2k\pi}{z+1} \ge 2\pi,$$

$$\xi = A + 2k\frac{\pi}{z+1},$$

and the adjacent rectilinear sections of the stator profile are conjugated between them by z+1 curvilinear sections, each of the latter being an arch corresponding either to the following parametric equation:

$$x' = e\left[\frac{z+3}{2}\cos\vartheta + \frac{z-1}{2}\cos\tau - a^*\sin(B-A)\sin\mu\right], \quad (5)$$

$$y' = e\left[-\frac{z+3}{2}\sin\vartheta + \frac{z-1}{2}\sin\tau + a^*\sin(B-A)\cos\mu\right],$$

where: x', y' are current coordinates of conjugating arch points along the $O_1X_1$, $O_1Y_1$ axes;

θ is a parameter (FIGS. 4, 6) representing a rotation angle of the driving shaft connected to the small gear 4 and determined at the following section:

$$\frac{z-1}{z+1}k\pi - A \le \vartheta \le \frac{z-1}{z+1}(k+1)\pi - A,$$

if k is an even number and B−A<0, or if k is an odd number and B−A>0, or θ is a parameter determined at the following section:

$$\frac{z-1}{z+1}(k+z+1)\pi - A \le \vartheta \le \frac{z-1}{z+1}(k+z+2)\pi - A,$$

if z is an even number, k is an odd number and B−A<0, or if z is an even number, k is an even number and B−A>0, $$\tau = \frac{(z+3)}{z-1}\vartheta + 2\frac{z+1}{z-1}A,$$

$$\mu = \frac{2}{z-1}\vartheta + \frac{z+1}{z-1}A,$$

or to the following parametric equation:

$$x' = e\left[\begin{array}{c}\frac{z+3}{2}\cos\left(\vartheta - \frac{2\pi}{z+1}\right) + \frac{z-1}{2}\cos\left(\tau + \frac{2\pi}{z+1}\right) - \\ a^*\sin(B-A)\sin\left(\mu + \frac{2\pi}{z+1}\right)\end{array}\right], \quad (6)$$

$$y' = e\left[\begin{array}{c}-\frac{z+3}{2}\sin\left(\vartheta - \frac{2\pi}{z+1}\right) + \frac{z-1}{2}\sin\left(\tau + \frac{2\pi}{z+1}\right) - \\ a^*\sin(B-A)\cos\left(\mu + \frac{2\pi}{z+1}\right)\end{array}\right],$$

where: θ is a parameter determined at the following section:

$$\frac{z-1}{z+1}(k+1)\pi - A \le \vartheta \le \frac{z-1}{z+1}k\pi - A,$$

if z is an odd number, k is an odd number and B−A<0, or θ is a parameter determined at the following section:

$$\frac{z-1}{z+1}(k-1)\pi - A \le \vartheta \le \frac{z-1}{z+1}k\pi - A,$$

if z is an odd number, k is an even number and B−A>0.

Figure 13:
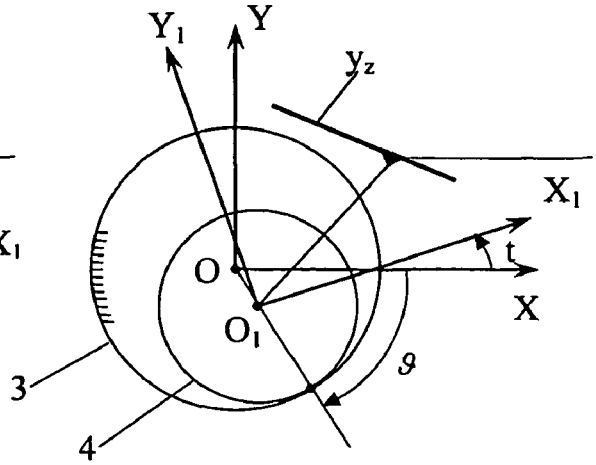
FIG. 13—same as FIG. 12, for intermediate positions of the large and the small gears.

Profile construction for the rotor 2 (FIGS. 12, 13) in the second embodiment of the invention is determination of an envelope for a Lz family of straight lines $y_z$.

A Lz family, if z is fixed, is formed during running around the fixed large gear 3 with inner engagement by the small gear 4 with external engagement. During this, the respective rotation angle θ of the $OO_1$ section (its length is equal to the eccentricity value e) and the rotation angle t of the small gear 4 correspond to each moment of time. During running around, the straight line $y_z$ does not change its position in the $OX_1Y_1$ coordinate system, which is movable and connected to the large gear, but its position in the OXY coordinate system, which is fixed and connected to the small gear 3, is constantly changed.

The parametric equation for the envelope of the Lz family, i.e., for the profile of the rotor 2, in the OXY coordinate system, has, as described above, the following form:

$$x = e\left[\frac{z+2}{2}\cos\alpha_1 + \frac{z}{2}\cos\beta_1 - a^*\sin(B-A)\sin\gamma_1)\right], \quad (7)$$

$$y = e\left[\frac{z+2}{2}\sin\alpha_1 - \frac{z}{2}\sin\beta_1 + a^*\sin(B-A)\cos\gamma_1\right],$$

where: x, y are current coordinates of the profile points of the rotor 2 along the X, Y axes of the OXY Cartesian coordinate system the beginning of which is at the center of the large gear 3;

e is an eccentricity value;

z is an engagement parameter, z=2, 3 . . . ;

a* is the form parameter defined as a*=a/e and satisfying the following condition:

$$a^* \geq \frac{z(z+2)}{|\sin(B-A)|},$$

$$\alpha_1 = zt,$$

t is a rotation angle of the small gear 4 relative to the large gear 3, which is counted from the X axis in the OXY coordinate system the beginning of which is at the center of the large gear 3, serving as a parameter, $0 \leqq t \leqq 2\pi$, $$\beta_1=(z+2)t+2A,$$

$$\gamma_1=t+A,$$

Figure 14:
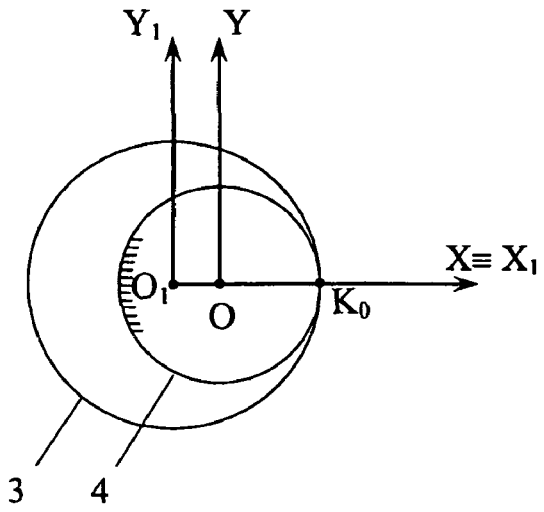
FIG. 14 shows the initial positions of the planetary train large and small gears for the second embodiment of the invention when constructing the stator inner surface profile.
Figure 15:
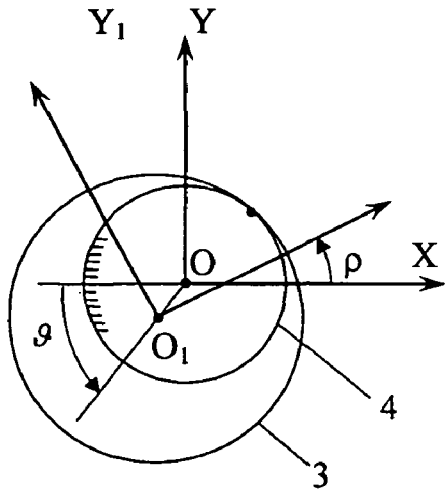
FIG. 15—same as FIG. 14, for intermediate positions of the large and the small gears.

Profile construction for the stator 1 (FIGS. 13, 14) in the second embodiment of the invention is also connected with determining an envelope, but now for a Kz family of curved lines formed during running around the small gear 4 by the large gear 3, and more correctly during running around the rotor 2 connected to the small gear, where a definite position of its profile curve corresponds to each rotation angle. A totality of such curves will form a Kz family of curved lines. At this point the indexation of the coordinate systems is changed: now the $O_1X_1Y_1$ movable system relates to the large gear 3, and the OXY fixed system relates to the small gear 4. And the beginnings of these systems are located at the respective centers of the large gear 3 and the small gear 4.

The envelope of the Kz family, i.e., the profile of the stator 1, consists of z rectilinear sections, and the parametric equation for each of them has the following form:

$$x_n=e[z\cos\delta_1\cos\eta_1-a^*\sin(B-A)\sin\xi_1],$$

$$y_n=e[z\sin\delta_1\cos\eta_1+a^*\sin(B-A)\cos\xi_1], \quad (8)$$

where: $x_n$, $y_n$ are current coordinates of the stator profile points along the $X_1$, $Y_1$ axes of the $O_1X_1Y_1$ Cartesian coordinate system the beginning of which is at the center of the small gear 4;

n=0, 1, . . . , (z−1) is the number of a rectilinear section;

$$\delta_1 = A + 2n\frac{\pi}{z},$$

$$\pi = 3{,}14,$$

$$\eta_1 = (z+1)\rho - \left(A + 2n\frac{\pi}{z}\right),$$

ρ is a rotation angle of the large gear 3 relative to the small gear 4, which is counted from the $X_1$ axis in the $O_1X_1Y_1$ coordinate system the beginning of which is at the center of the small gear 4, serving as a parameter, for which:

$$A + \frac{2n\pi}{z} \leq (z+1)\rho \leq \pi + \left(A + \frac{2n\pi}{z}\right),$$

$$\text{if } 0 \leq A + \frac{2n\pi}{z} \leq \pi,$$

$$A + \frac{2n\pi}{z} - \pi \leq (z+1)\rho \leq A + \frac{2n\pi}{z},$$

-continued $$\text{if } B - A < 0$$

and $$\pi \leq A + \frac{2n\pi}{z} \leq 2\pi,$$

or if $B - A > 0$ and $$A + \frac{2n\pi}{z} \geq \pi,$$

$$A + \frac{2n\pi}{z} - 2\pi \leq (z+1)\rho \leq A + \frac{2n\pi}{z} - \pi,$$

$$\text{if } B - A < 0$$

and $$A + \frac{2n\pi}{z} \geq 2\pi,$$

$$\xi_1 = A + 2n\frac{\pi}{z},$$

and the adjacent rectilinear sections of the profile of the stator 1 are conjugated between them by z curvilinear sections, each of the latter being an arch corresponding either to the following parametric equation:

$$x' = e\left[\frac{z-2}{2}\cos\vartheta + \frac{z+2}{2}\cos\tau_1 - a^*\sin(B-A)\sin\mu_1\right],$$
$$y' = e\left[\frac{z-2}{2}\sin\vartheta - \frac{z+2}{2}\sin\tau_1 + a^*\sin(B-A)\cos\mu_1\right], \quad (9)$$

where: x', y' are current coordinates of the conjugating arches along the $O_1X_1$, $O_1Y_1$ axes;

θ is a parameter determined at the following section:

$$\frac{z+2}{z}k\pi + A \leq \vartheta \leq \frac{z+2}{z}(k+1)\pi + A,$$

if k is an even number and B−A<0, or if k is an odd number and B−A>0;

or θ is a parameter determined at the following section:

$$\frac{z+2}{z}(k+z)\pi + A \leq \vartheta \leq \frac{z+2}{z}(k+z+1)\pi + A,$$

if z is an odd number, k is an odd number and B−A<0, or if z is an odd number, k is an even number and B−A>0;

$$\tau_1 = \frac{z-2}{z+2}\vartheta - \frac{2z}{z+2}A,$$

$$\mu_1 = \frac{2}{z+2}\vartheta + \frac{z}{z+2}A,$$

or to the following parametric equation:

$$x' = e\left[\frac{z-2}{2}\cos\left(\vartheta + \frac{2\pi}{z}\right) + \frac{z+2}{2}\cos\left(\tau_1 - \frac{2\pi}{z}\right) - a^*\sin(B-A)\sin\left(\mu_1 + \frac{2\pi}{z}\right)\right], \quad (10)$$

-continued $$y' = e\left[\begin{array}{c}\frac{z-2}{2}\sin\left(\vartheta+\frac{2\pi}{z}\right)-\frac{z+2}{2}\sin\left(\tau_1'-\frac{2\pi}{z}\right)+\\ a^*\sin(B-A)\cos\left(\mu_1+\frac{2\pi}{z}\right)\end{array}\right],$$

where: θ is a parameter determined at the following section $$\frac{z+2}{z}(k-1)\pi+A \le \vartheta \le \frac{z+2}{z}k\pi+A,$$

if z is an even number, k is an odd number and B−A<0, or if z is an even number, k is an even number and B−A>0.

For the first proposed embodiment of the invention the use of configurations with a two-vertex rotor (FIG. 7) in compressors and pumps is characterized by a high (more than 1) specific capacity, and at this factor discriminant compressors and pumps, in the case where z=2, have no analogous solutions in the rotary and general engineering; they may be applied in the fields where the principal requirement is to achieve the least dimension-weight characteristics. The application of such configurations in internal combustion engines is problematic due to high compression ratio (it may be as high as 120). For configurations with a three-vertex rotor (z=3) and a four-vertex rotor (z=4), which are shown in FIGS. 8 and 9, respectively, as compared to the case of z=2, specific factors are significantly lower (e.g., maximum specific capacity of discriminant compressors is 0.45 at z=3 and 0.25 at z=4). Therefore, such configurations may be recommended for compressors and pumps in cases where, apart from requirements concerning dimension-weight characteristics, certain requirements also exist to pressure pulsation levels and output shaft rotation degree of uniformity. At the same time, a maximum compression ratio typical for such configurations (45 at z=3 and 29 at z=4), enables to use such configurations in rotary engines by selecting a corresponding value for the form parameter a*.

Figure 16:
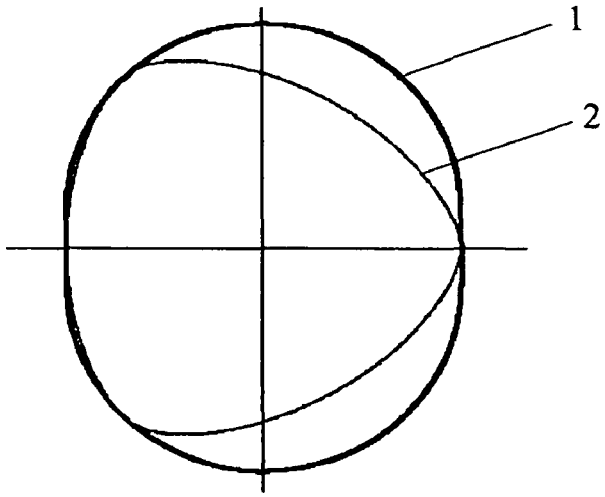
FIG. 16—an exemplary rotor-stator configuration according to the second embodiment of the invention for z=2.
Figure 17:
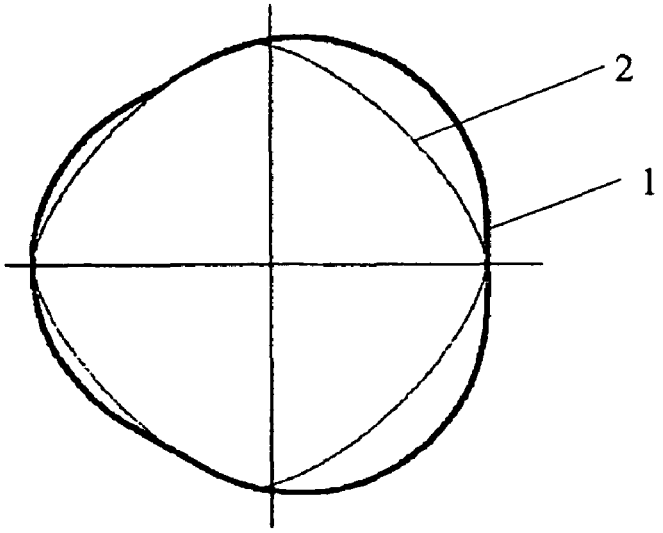
FIG. 17—same as FIG. 16, for z=3.
Figure 18:
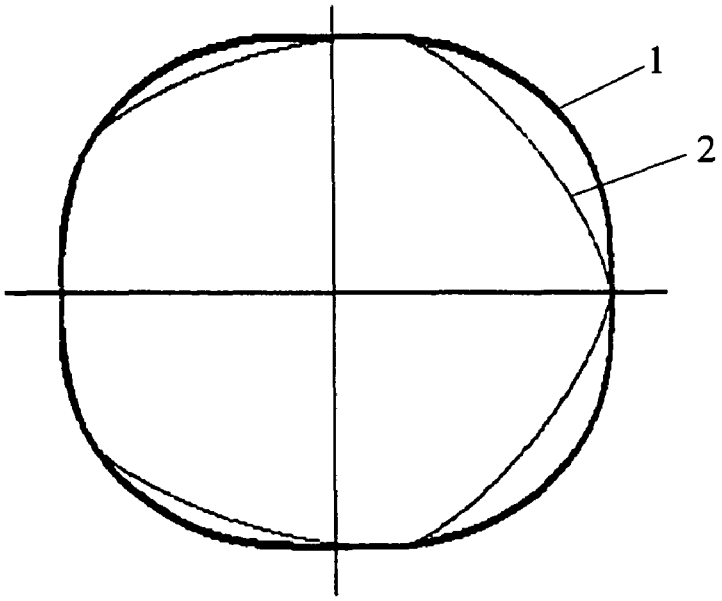
FIG. 18—same as FIG. 16, for z=4.

The distinguishing feature of configurations for the second embodiment of the invention (FIG. 16-18) is that by their specific factors at z=2-4 these configurations are much inferior to those for the first embodiment, but such inferiority decreases with the increasing z-parameter, and at z>10 it practically disappears. The advantage of such configurations over those for the first embodiment is that at their use the problem of sealing working chambers may be solved to a great extent due to a lesser length of the seal perimeter. With due regard to this fact, at z>10 the second embodiment of the invention is preferable. The necessity in using configurations with a higher z-parameter value arises in cases where requirements to power units exist, which regulate the low threshold of pressure pulsations and maximum possible smoothness of running (for example, in medicine).

Any possibility of using configurations according to the second embodiment of the invention in rotary engines is practically excluded, since compression ratio cannot be higher than 6. Configurations with a three-vertex rotor (FIG. 14) are prospective for use in household pumps, which is conditioned by simplicity of their manufacturing.

A value of the form parameter a* selected for compressors and pumps should be minimal, since in such a case the greatest specific capacity can be achieved, and such a value for engines should be significantly greater than minimal in order to ensure a necessary compression ratio in working chambers. Values of the angular parameters A and B should be selected on the basis of technological factors and assembly conditions.

When selecting a value for the z-parameter, it should be borne in mind that the higher is this value, the lower is specific capacity for compressors and pumps and specific power for engines, but, at the same time, an increase in it leads to lower levels of pulsations at the output of compressors and pumps and the output shaft rotation degree of non-uniformity for all types of piston rotary machines, including engines.

The proposed embodiments of positive-displacement machines contain structural prerequisites conditioned by geometric and kinematic features of rotor-stator discriminant configurations and enabling to solve tasks of distributing a working body and sealing working chambers with high technical and economic efficiency. In the long run, this raises factors of service life, reliability and specific speed to a significantly higher level than that existing now not only in rotary, but also in general engineering.

Out of the other features of the proposed embodiments of piston rotary machines the following may be mentioned:

- When using the proposed devices as rotary engines, the form of combustion chambers is optimal (hemispherical), which is equivalent to a real possibility of creating favorable conditions for working processes. As a result, working mixture combustion efficiency and thermodynamic efficiency are at least not lower than in conventional internal combustion engines or, moreover, in rotary engines of trochoid type (Wankel engines), which are most widely used today; so, high efficiency (first of all, fuel efficiency) and compliance with environmental standards are ensured.
- Heat factor is much less pronounced compared to that in trochoid and conventional power units. The reason for this is "deep" symmetry (relative to the longitudinal axis) of discriminant configurations. This assessment of specific features of discriminant machine symmetry should be interpreted in the sense that it not only characterizes the very geometry of such machines and the arrangement of working chambers in them, but also includes the fact that fields of temperature, kinematic and power factors are central. The latter fact enables, in particular by selecting necessary materials for the rotor and the stator, to reduce significantly heat load imbalances and heat distortions in the rotor-stator configuration. This, in its turn, excludes the presence of parasitic power contacts in the rotor-stator pair practically to the fullest extent, i.e., in the long run it drastically decreases wear and risk of jamming conditioned by heat conditions.
- High specific factors (for example the specific capacity of discriminant compressors is twice as high as that of trochoid ones), not allowing to lose advantages of new piston rotary power units, which are conditioned by their specific speed. As calculations show, at given similar output characteristics, dimensions and weights of discriminant machines, irrespective of application, are 3 to 4 times lower than those of reciprocating power units and 1.5 to 2 times lower than those of trochoid units.

Industrial Applicability

The proposed embodiments of a positive-displacement machine may be most successfully applied in internal combustion engines, pumps or compressors.

What is claimed is:

1. A positive-displacement machine design comprising a stator, a rotor eccentrically installed in the stator, a planetary train composed of a large gear and a small gear, where the large gear is fixedly arranged from the outside of the small gear and in engagement therewith, the small gear being made with the possibility of running around the large gear of the planetary train, the stator is connected to the large gear, and the rotor is connected to the small gear of the planetary train, the external surface profile of the rotor in its cross section is an envelope of a straight line family, and the straight line $y_z$, which generates the said family, is fixedly connected to the large gear and is set, in the $O_1X_1Y_1$ coordinate system the beginning of which is at the center of the large gear, by the following equation:

$$y_z = tgA \cdot x_1 + \frac{\sin(B-A)}{\cos A} \cdot a,$$

where: A is the inclination angle of the straight line $y_z$ to the axis $O_1X_1$, ($0 \leqq A \leqq \pi$);

$x_1$ is the coordinate of the current point of the straight line $y_z$ along $O_1X_1$;

B is the inclination angle of a section connecting the beginning $O_1$ of the $O_1X_1Y_1$ coordinate system to the straight line $y_z$ and calculated from the axis $O_1X_1$ ($0 \leqq B \leqq \pi$ and $B \neq A$);

a is length of the section connecting the beginning $O_1$ of the $O_1X_1Y_1$ coordinate system to the straight line $y_z$;

and the profile is made in accordance with the following parametric equation:

$$x = e\left[\frac{z-1}{2}\cos\alpha + \frac{z+1}{2}\cos\beta - a^*\sin(B-A)\sin\gamma)\right],$$

$$y = e\left[\frac{z-1}{2}\sin\alpha - \frac{z+1}{2}\sin\beta + a^*\sin(B-A)\cos\gamma\right],$$

where: x, y are current coordinates of the profile points along the axes X, Y of the OXY Cartesian coordinate system the beginning of which is at the center of the small gear;

e is an eccentricity value;

z is an engagement parameter, z=2, 3 . . . ;

$\alpha=(z+1)\Psi$, $\Psi$ is a rotation angle of the large gear relative to the small gear, which is counted from the X axis in the OXY coordinate system the beginning of which is at the center of the small gear, serving as a parameter, $0 \leqq \Psi \leqq 2\pi$, $$\beta=(z-1)\psi-2A,$$

$$\gamma=\psi+A,$$

a* is a form parameter defined as a*=a/e and satisfying the following condition:

$$a^* \geq \frac{z^2-1}{|\sin(B-A)|},$$

and the inner surface profile of the stator in its cross section is made of z+1 rectilinear sections, each of them made corresponding to the following parametric equation:

$$x_k=e[(z+1)\cos\delta\cos\eta-a^*\sin(B-A)\sin\xi],$$

$$y_k=e[(z+1)\sin\delta\cos\eta+a^*\sin(B-A)\cos\xi],$$

where: $x_k$, $y_k$ are current coordinates of the stator profile points along the axes $X_1$, $Y_1$ of the $O_1X_1Y_1$ Cartesian coordinate system the beginning of which is at the center of the large gear;

k=0, 1, . . . z is the number of a rectilinear section, $$\delta = A + 2k\frac{\pi}{z+1},$$

$$\pi = 3{,}14,$$

$$\eta = z\chi + A + 2k\frac{\pi}{z+1},$$

$\chi$ is a rotation angle of the small gear relative to the large gear, which is counted from the axis $X_1$ in the $O_1X_1Y_1$ coordinate system the beginning of which is at the center of the large gear, serving as a parameter, for which:

$$\pi - \left(A + \frac{2k\pi}{z+1}\right) \leq z\chi \leq 2\pi - \left(A + \frac{2k\pi}{z+1}\right),$$

$$\text{if } 0 \leq A + \frac{2k\pi}{z+1} \leq \pi,$$

$$2\pi - \left(A + \frac{2k\pi}{z+1}\right) \leq z\chi \leq 3\pi - \left(A + \frac{2k\pi}{z+1}\right),$$

$$\text{if } B - A < 0$$

and $$\pi \leq A + \frac{2k\pi}{z+1} \leq 2\pi,$$

or if $B - A > 0$ and $$A + \frac{2k\pi}{z+1} \geq \pi,$$

$$3\pi - \left(A + \frac{2k\pi}{z+1}\right) \leq z\chi \leq 4\pi - \left(A + \frac{2k\pi}{z+1}\right),$$

$$\text{if } B - A < 0$$

and $$A + \frac{2k\pi}{z+1} \geq 2\pi,$$

$$\xi = A + 2k\frac{\pi}{z+1},$$

where adjacent rectilinear sections of the stator profile are conjugated between them by z+1 curvilinear sections, each of the latter being made as an arch corresponding either to the following parametric equation:

$$x' = e\left[\frac{z+3}{2}\cos\vartheta + \frac{z-1}{2}\cos\tau - a^*\sin(B-A)\sin\mu\right],$$

$$y' = e\left[-\frac{z+3}{2}\sin\vartheta + \frac{z-1}{2}\sin\tau + a^*\sin(B-A)\cos\mu\right],$$

where x', y' are current coordinates of the conjugating arches along the axes $O_1X_1$, $O_1Y_1$;

θ is parameter defined on the section $$\frac{z-1}{z+1}k\pi - A \le \vartheta \le \frac{z-1}{z+1}(k+1)\pi - A,$$

if k is an even number and B−A<0, or if k is an odd number and B−A>0;

or θ is parameter defined on the section $$\frac{z-1}{z+1}(k+z+1)\pi - A \le \vartheta \le \frac{z-1}{z+1}(k+z+2)\pi - A,$$

if z is an even number, k is an odd number and B−A<0, or if z is an even number, k if an odd number and B−A>0, $$\tau = \frac{(z+3)}{z-1}\vartheta + 2\frac{z+1}{z-1}A,$$

$$\mu = \frac{2}{z-1}\vartheta + \frac{z+1}{z-1}A,$$

or to the following parametric equation:

$$x' = e\left[\begin{array}{c}\frac{z+3}{2}\cos\left(\vartheta - \frac{2\pi}{z+1}\right) + \frac{z-1}{2}\cos\left(\tau + \frac{2\pi}{z+1}\right) - \\ a * \sin(B-A)\sin\left(\mu + \frac{2\pi}{z+1}\right)\end{array}\right],$$

$$y' = e\left[\begin{array}{c}-\frac{z+3}{2}\sin\left(\vartheta - \frac{2\pi}{z+1}\right) + \frac{z-1}{2}\sin\left(\tau + \frac{2\pi}{z+1}\right) + \\ a * \sin(B-A)\cos\left(\mu + \frac{2\pi}{z+1}\right)\end{array}\right],$$

where: θ is parameter defined on the section $$\frac{z-1}{z+1}(k+1)\pi - A \le \vartheta \le \frac{z-1}{z+1}k\pi - A,$$

if z is an odd number, k is an odd number and B−A<0;

or θ is parameter defined on the section $$\frac{z-1}{z+1}(k-1)\pi - A \le \vartheta \le \frac{z-1}{z+1}k\pi - A,$$

if z is an odd number, k if an even number and B−A>0.

2. A positive-displacement machine design comprising a stator, a rotor eccentrically installed in the stator, a planetary train composed of a large gear and a small gear, where the small gear is arranged on the inside of the large gear and in engagement therewith, the small gear being fixedly installed, and the large gear is made with the possibility of running around the small gear of the planetary train, the stator is connected to the small gear, and the rotor is connected to the large gear of the planetary train, the external surface profile of the rotor in its cross section is an envelope of a straight line family, and the straight line $y_z$, which generates the said family, is fixedly connected to the small gear and is set, in the $O_1X_1Y_1$ coordinate system the beginning of which is at the center of the large gear, by the following equation:

$$y_z = tgA \cdot x_1 + \frac{\sin(B-A)}{\cos A} \cdot a,$$

where: A is the inclination angle of the straight line $y_z$ to the axis $O_1X_1$, (0≦A≦π);

$x_1$ is the coordinate of the current point of the straight line $y_z$ along $O_1X_1$;

B is the inclination angle of a section connecting the beginning $O_1$ of the $O_1X_1Y_1$ coordinate system to the straight line $y_z$ and calculated from the axis $O_1X_1$ (0≦B≦π and B≠A);

a is length of the section connecting the beginning $O_1$ of the $O_1X_1Y_1$ coordinate system to the straight line $y_z$;

and the rotor external surface profile is made in accordance with the following parametric equation:

$$x = e\left[\frac{z+2}{2}\cos\alpha_1 + \frac{z}{2}\cos\beta_1 - a^*\sin(B-A)\sin\gamma_1)\right],$$

$$y = e\left[-\frac{z+2}{2}\sin\alpha_1 - \frac{z}{2}\sin\beta_1 + a^*\sin(B-A)\cos\gamma_1\right],$$

where: x, y are current coordinates of the profile points along the axes X, Y of the OXY Cartesian coordinate system the beginning of which is at the center of the large gear;

e is an eccentricity value;

z is an engagement parameter, z=2, 3 . . . ;

a* is a form parameter defined as a*=a/e and satisfying the following condition:

$$a^* \ge \frac{z(z+2)}{|\sin(B-A)|},$$

$$\alpha_1 = zt$$

t is a rotation angle of the small gear relative to the large gear, which is counted from the axis X in the OXY coordinate system the beginning of which is at the center of the large gear, serving as a parameter, for which 0≦t≦2π;

$$\beta_1 = (z+2)t + 2A,$$

$$\gamma_1 = t + A,$$

and the inner surface profile of the stator in its cross section is made of z rectilinear sections, each of them made corresponding to the following parametric equation:

$$x_n = e[z\cos\delta_1\cos\eta_1 - a^*\sin(B-A)\sin\xi_1],$$

$$y_n = e[z\sin\delta_1\cos\eta_1 + a^*\sin(B-A)\cos\xi_1],$$

where $x_n$, $y_n$ are current coordinates of the stator profile points along the axes $X_1$, $Y_1$ of the $O_1X_1Y_1$ Cartesian coordinate system the beginning of which is at the center of the small gear;

n=0, 1, . . . (z−1) is the number of a rectilinear section, $$\delta_1 = A + 2n\frac{\pi}{z},$$

$$\pi = 3{,}14,$$

$$\eta_1 = (z+1)\rho - \left(A + 2n\frac{\pi}{z}\right),$$

ρ is a rotation angle of the large gear relative to the small gear, which is counted from the axis $X_1$ in the $O_1X_1Y_1$ coordinate system the beginning of which is at the center of the small gear, serving as a parameter, for which:

$$A + \frac{2n\pi}{z} \le (z+1)\rho \le \pi + \left(A + \frac{2n\pi}{z}\right), \text{ if } 0 \le A + \frac{2n\pi}{z} \le \pi,$$

$$A + \frac{2n\pi}{z} - \pi \le (z+1)\rho \le A + \frac{2n\pi}{z}, \text{ if } B - A < 0 \text{ and}$$

$$\pi \le A + \frac{2n\pi}{z} \le 2\pi, \text{ or if } B - A > 0 \text{ and } A + \frac{2n\pi}{z} \ge \pi,$$

$$A + \frac{2n\pi}{z} - 2\pi \le (z+1)\rho \le A + \frac{2n\pi}{z} - \pi, \text{ if } B - A < 0 \text{ and}$$

$$A + \frac{2n\pi}{z} \ge 2\pi,$$

$$\xi_1 = A + 2n\frac{\pi}{z},$$

where adjacent rectilinear sections of the stator profile are conjugated between them by z curvilinear sections, each of the latter being made as an arch corresponding either to the following parametric equation:

$$x' = e\left[\frac{z-2}{2}\cos\vartheta + \frac{z+2}{2}\cos\tau_1 - a^*\sin(B-A)\sin\mu_1\right],$$

$$y' = e\left[\frac{z-2}{2}\sin\vartheta - \frac{z+2}{2}\sin\tau_1 + a^*\sin(B-A)\cos\mu_1\right],$$

where x', y' are current coordinates of the conjugating arches along the axes $O_1X_1$, $O_1Y_1$;

θ is parameter defined on the section $$\frac{z+2}{z}k\pi + A \le \vartheta \le \frac{z+2}{z}(k+1)\pi + A,$$

if k is an even number and B−A<0, or if k is an odd number and B−A>0, or θ is parameter defined on the section $$\frac{z+2}{z}(k+z)\pi + A \le \vartheta \le \frac{z+2}{z}(k+z+1)\pi + A,$$

if z is an odd number, k is an odd number and B−A<0, or if z is an odd number, k is an even number and B−A>0

$$\tau_1 = \frac{z-2}{z+2}\vartheta - \frac{2z}{z+2}A,$$

$$\mu_1 = \frac{2}{z+2}\vartheta + \frac{z}{z+2}A,$$

or to the following parametric equation:

$$x' = e\left[\begin{array}{c}\frac{z-2}{2}\cos\left(\vartheta + \frac{2\pi}{z}\right) + \frac{z+2}{2}\cos\left(\tau_1 - \frac{2\pi}{z}\right) - \\ a^*\sin(B-A)\sin\left(\mu_1 + \frac{2\pi}{z}\right)\end{array}\right],$$

$$y' = e\left[\begin{array}{c}\frac{z-2}{2}\sin\left(\vartheta + \frac{2\pi}{z}\right) - \frac{z+2}{2}\sin\left(\tau_1' - \frac{2\pi}{z}\right) + \\ a^*\sin(B-A)\cos\left(\mu_1 + \frac{2\pi}{z}\right)\end{array}\right],$$

where θ is parameter defined on the section $$\frac{z+2}{z}(k-1)\pi + A \le \vartheta \le \frac{z+2}{z}k\pi + A,$$

if z is an even number, k is an odd number and B−A<0, or if z is an even number, k is an even number and B−A>0.

* * * * *